US007994880B2

(12) United States Patent
Chen et al.

(10) Patent No.: US 7,994,880 B2
(45) Date of Patent: Aug. 9, 2011

(54) ENERGY TRANSFERRING SYSTEM AND METHOD THEREOF

(75) Inventors: Chih-Jung Chen, Taichung County (TW); Chih-Lung Lin, Tainan (TW); Zuei-Chown Jou, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 515 days.

(21) Appl. No.: 12/141,972

(22) Filed: Jun. 19, 2008

(65) Prior Publication Data

US 2009/0153273 A1 Jun. 18, 2009

(30) Foreign Application Priority Data

Dec. 14, 2007 (TW) ..... 96148037 A

(51) Int. Cl.
*H01P 7/00* (2006.01)

(52) U.S. Cl. ..... 333/219; 307/104

(58) Field of Classification Search ..... 307/104; 333/219

See application file for complete search history.

(56) References Cited

U.S. PATENT DOCUMENTS

| | | | | |
|---|---|---|---|---|
| 7,741,734 | B2 * | 6/2010 | Joannopoulos et al. | 307/104 |
| 2008/0067874 | A1 * | 3/2008 | Tseng | 307/104 |
| 2009/0051224 | A1 * | 2/2009 | Cook et al. | 307/104 |
| 2009/0195332 | A1 * | 8/2009 | Joannopoulos et al. | 333/202 |
| 2009/0195333 | A1 * | 8/2009 | Joannopoulos et al. | 333/202 |
| 2009/0267709 | A1 * | 10/2009 | Joannopoulos et al. | 333/219 |
| 2009/0267710 | A1 * | 10/2009 | Joannopoulos et al. | 333/219 |
| 2010/0096934 | A1 * | 4/2010 | Joannopoulos et al. | 307/104 |
| 2010/0102639 | A1 * | 4/2010 | Joannopoulos et al. | 307/104 |
| 2010/0102640 | A1 * | 4/2010 | Joannopoulos et al. | 307/104 |
| 2010/0102641 | A1 * | 4/2010 | Joannopoulos et al. | 307/104 |
| 2010/0117455 | A1 * | 5/2010 | Joannopoulos et al. | 307/104 |
| 2010/0123353 | A1 * | 5/2010 | Joannopoulos et al. | 307/104 |
| 2010/0123354 | A1 * | 5/2010 | Joannopoulos et al. | 307/104 |
| 2010/0123355 | A1 * | 5/2010 | Joannopoulos et al. | 307/104 |

(Continued)

FOREIGN PATENT DOCUMENTS

JP 2008-508842 3/2008

(Continued)

OTHER PUBLICATIONS

English language translation of abstract of JP 2008-508842 (published Mar. 21, 2008).

*Primary Examiner* — Jared J Fureman
*Assistant Examiner* — Daniel Cavallari
(74) *Attorney, Agent, or Firm* — Thomas|Kayden

(57) ABSTRACT

An energy transferring system including a source-side resonator, an intermediate resonant module, and a device-side resonator is provided. The three resonators substantially have the same resonant frequency for generating resonance. The energy on the source-side resonator is coupled to the intermediate resonant module, such that non-radiative energy transfer is performed between the source-side resonator and the intermediate resonant module. The energy coupled to the intermediate resonant module is further coupled to the device-side resonator, such that non-radiative energy transfer is performed between the intermediate resonant module and the device-side resonator to achieve energy transfer between the source-side resonator and the device-side resonator. The coupling coefficient between the intermediate resonant module and its two adjacent resonators is larger than the coupling coefficient between the source-side resonator and the device-side resonator. The invention has the advantages of high transmission efficiency, small volume, low cost.

16 Claims, 12 Drawing Sheets

U.S. PATENT DOCUMENTS

2010/0127573 A1* 5/2010 Joannopoulos et al. ..... 307/104
2010/0127574 A1* 5/2010 Joannopoulos et al. ..... 307/104
2010/0127575 A1* 5/2010 Joannopoulos et al. ..... 307/104
2010/0133918 A1* 6/2010 Joannopoulos et al. ..... 307/104
2010/0133919 A1* 6/2010 Joannopoulos et al. ..... 307/104
2010/0133920 A1* 6/2010 Joannopoulos et al. ..... 307/104
2010/0148589 A1* 6/2010 Hamam et al. ..... 307/104
2010/0187911 A1* 7/2010 Joannopoulos et al. ..... 307/104
2010/0207458 A1* 8/2010 Joannopoulos et al. ..... 307/104
2010/0264747 A1* 10/2010 Hall et al. ..... 307/104

FOREIGN PATENT DOCUMENTS

WO WO 2007-008646 1/2007

* cited by examiner

| | $Q_U$ | $Q_{EXT}$ | $Q_L$ | $Q_U/Q_{EXT}$ | Resonance frequency (MHz) |
|---|---|---|---|---|---|
| Source-side resonator 110 | 84 | 136.5 | $Q_U$ | 0.61 | 24.4 |
| Intermediate resonant module 122 | 84 | ∞ | 84 | 0 | 24.4 |
| Device-side resonator 130 | 84 | 136.5 | 52 | 0.61 | 24.4 |

ENERGY TRANSFERRING SYSTEM AND METHOD THEREOF

This application claims the benefit of Taiwan application Serial No. 096148037, filed Dec. 14, 2007, the subject matter of which is incorporated herein by reference.

BACKGROUND OF THE INVENTION

1. Field of the Invention

The invention relates in general to an energy transferring device and a method thereof, and more particularly to an energy transferring device which achieves energy transfer through energy coupling between resonators and a method thereof.

2. Description of the Related Art

There are many techniques of wireless transmission already used in the field of communication. Currently, conventional techniques of wireless transmission are mostly used in the reception and transmission of signals, and are hence only applicable to the transmission of low power signals.

As there are more and more electronic products adopt wireless transmission, the development of wireless transmission applicable to high power signals attracts more and more attention. United State Patent No. US2007/0222542 disclosed a wireless non-radiative energy transferor capable of transferring energy by a wireless power transfer (WPT) to transfer the power of a resonator to another resonator by way of resonance.

To achieve a predetermined level of transferring efficiency, the above transferor requires a high Q-factor resonator. However, such Q-factor resonator, which occupies a large volume and costs a lot, cannot be used in ordinary electronic products. Moreover, when the transferring distance is remote, the transferor can only achieve low efficiency in the transfer of energy. Therefore, how to design a wireless power transferring system having the features of small volume, low cost, and high transfer efficiency has become an important direction to people in the field of power transfer.

SUMMARY OF THE INVENTION

The invention is directed to an energy transferring system and a method thereof. Compared with the conventional wireless power transferring system, the energy transferring system of the invention has the advantages of higher energy transferring efficiency, smaller volume, and lower cost.

According to a first aspect of the present invention, an energy transferring system including a source-side resonator, an intermediate resonant module, and a device-side resonator is provided. The source-side resonator for receiving an energy has a first resonant frequency. The intermediate resonant module has a second resonant frequency substantially the same with the first resonant frequency. The energy on the source-side resonator is coupled to the intermediate resonant module, such that non-radiative energy transfer is performed between the source-side resonator and the intermediate resonant module. The coupling between the source-side resonator and the intermediate resonant module corresponds to a first coupling coefficient K1. The device-side resonator has a third resonant frequency substantially the same with the second resonant frequency. The energy coupled to the intermediate resonant module is further coupled to the device-side resonator, such that non-radiative energy transfer is performed between the intermediate resonant module and the device-side resonator. The coupling between the intermediate resonant module and the device-side resonator corresponds to a second coupling coefficient K2. When the intermediate resonant module does not exist, the coupling between the source-side resonator and the device-side resonator corresponds to a third coupling coefficient K3. The first coupling coefficient is larger than the third coupling coefficient, and the second coupling coefficient is larger than the third coupling coefficient. That is, K1>K3 and K2>K3.

According to a second aspect of the present invention, an energy transferring method including the following steps. Firstly, a source-side resonator is provided to receive an energy. Next, an intermediate resonant module is provided, wherein the energy on the source-side resonator is coupled to the intermediate resonant module, such that non-radiative energy transfer is performed between the source-side resonator and the intermediate resonant module, and the coupling between the source-side resonator and the intermediate resonant module corresponds to a first coupling coefficient K1. Then, the energy for coupling a device-side resonator to the intermediate resonant module is provided, wherein the energy is further coupled to the device-side resonator, such that non-radiative energy transfer is performed between the intermediate resonant module and the device-side resonator, and the coupling between the intermediate resonant module and the device-side resonator corresponds to a second coupling coefficient K2. When the intermediate resonant module does not exist, the coupling between the source-side resonator and the device-side resonator corresponds to a third coupling coefficient K3. The first coupling coefficient is larger than the third coupling coefficient, and the second coupling coefficient is larger than the third coupling coefficient. That is, K1>K3 and K2>K3.

The invention will become apparent from the following detailed description of the preferred but non-limiting embodiments. The following description is made with reference to the accompanying drawings.

DETAILED DESCRIPTION OF THE INVENTION

According to an energy transferring system of the invention, an intermediate resonant module is disposed between a source-side resonator and a device-side resonator for coupling energy from the source-side resonator and for coupling energy to the device-side resonator such that the overall transferring efficiency between the source-side resonator and the device-side resonator is enhanced.

Figure 1:
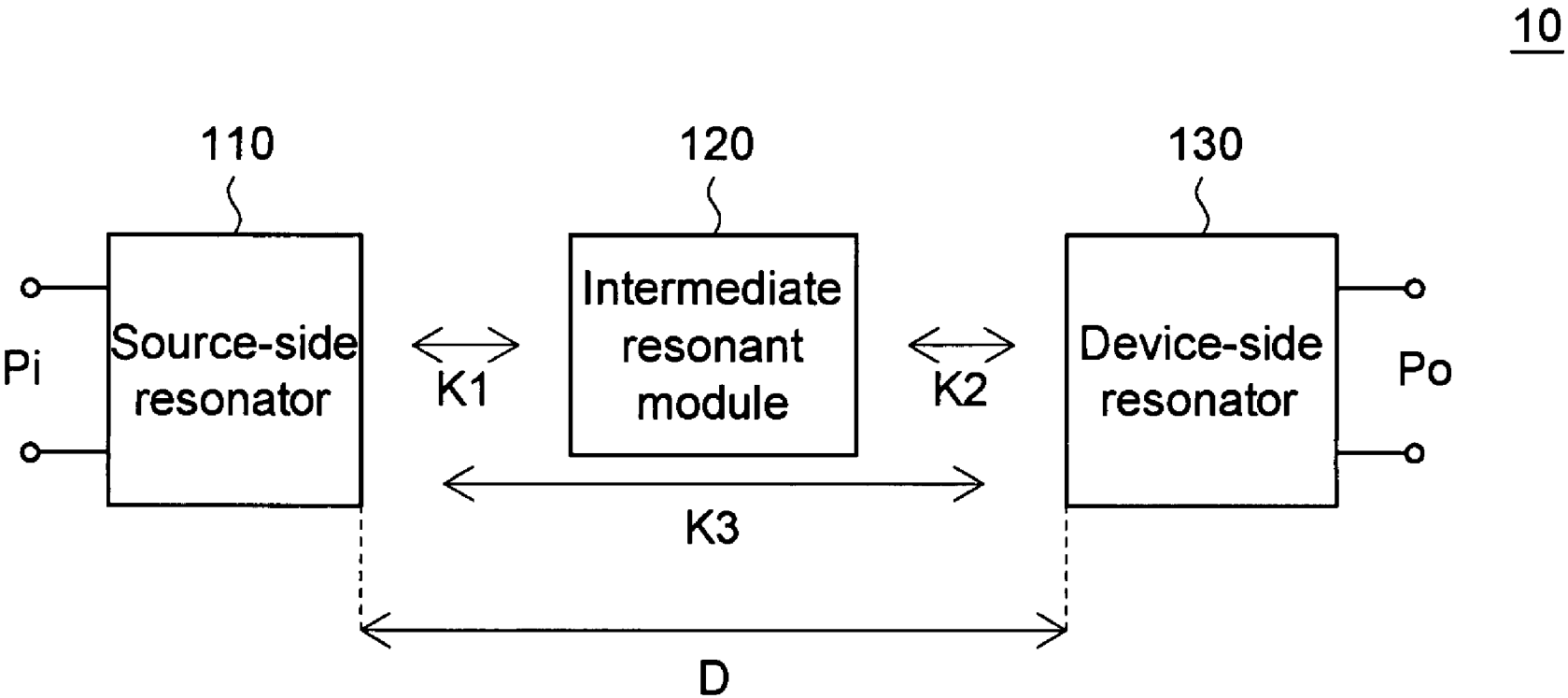
FIG. 1 shows a block diagram of an energy transferring system according to an embodiment of the invention.

Referring to FIG. 1, a block diagram of an energy transferring system according to an embodiment of the invention is shown. The energy transferring system 10 includes a source-side resonator 110, an intermediate resonant module 120 and a device-side resonator 130. The source-side resonator 110 receiving an energy Pi has a resonant frequency $f_1$.

The intermediate resonant module 120 includes at least one intermediate resonator having a resonant frequency $f_2$ substantially the same with the resonant frequency $f_1$. The energy Pi on the source-side resonator 110 is coupled to the intermediate resonant module 120, such that non-radiative energy transfer is performed between the source-side resonator 110 and the intermediate resonant module 120. The coupling between the source-side resonator 110 and the intermediate resonant module 120 corresponds to a first coupling coefficient.

The device-side resonator 130 has a resonant frequency $f_3$ substantially the same with the resonant frequency $f_2$. The energy coupled to the intermediate resonant module 120 is further coupled to the device-side resonator 130, such that non-radiative energy transfer is performed between the intermediate resonant module 120 and the device-side resonator 130. Thus, the device-side resonator 130 has an energy Po. The coupling between the intermediate resonant module 120 and the device-side resonator 130 corresponds to a second coupling coefficient.

Figure 14:
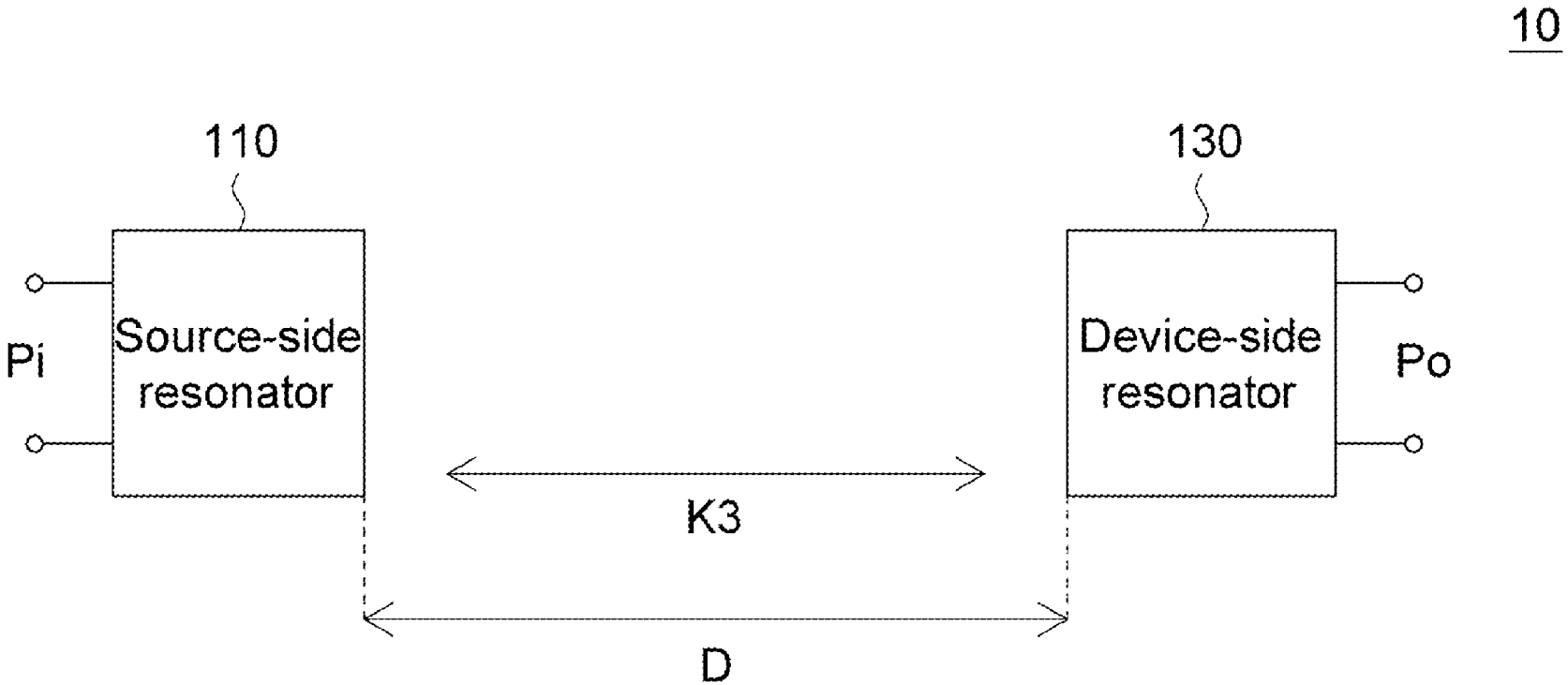
FIG. 14 shows another block diagram of an energy transferring system according to an embodiment of the invention.

When the intermediate resonant module 120 does not exist, as depicted in FIG. 14, the coupling between the source-side resonator 110 and the device-side resonator 130 corresponds to a third coupling coefficient. In the present embodiment of the invention, the first, the second, the third coupling coefficient satisfies the following relationship: the first coupling coefficient is larger than the third coupling coefficient, and the second coupling coefficient is larger than the third coupling coefficient. The coupling coefficient here is related to the ratio of the corresponding energy transferred between two resonators. A number of examples are disclosed below for elaborating the energy transferring system of the present embodiment of the invention.

Figure 2:
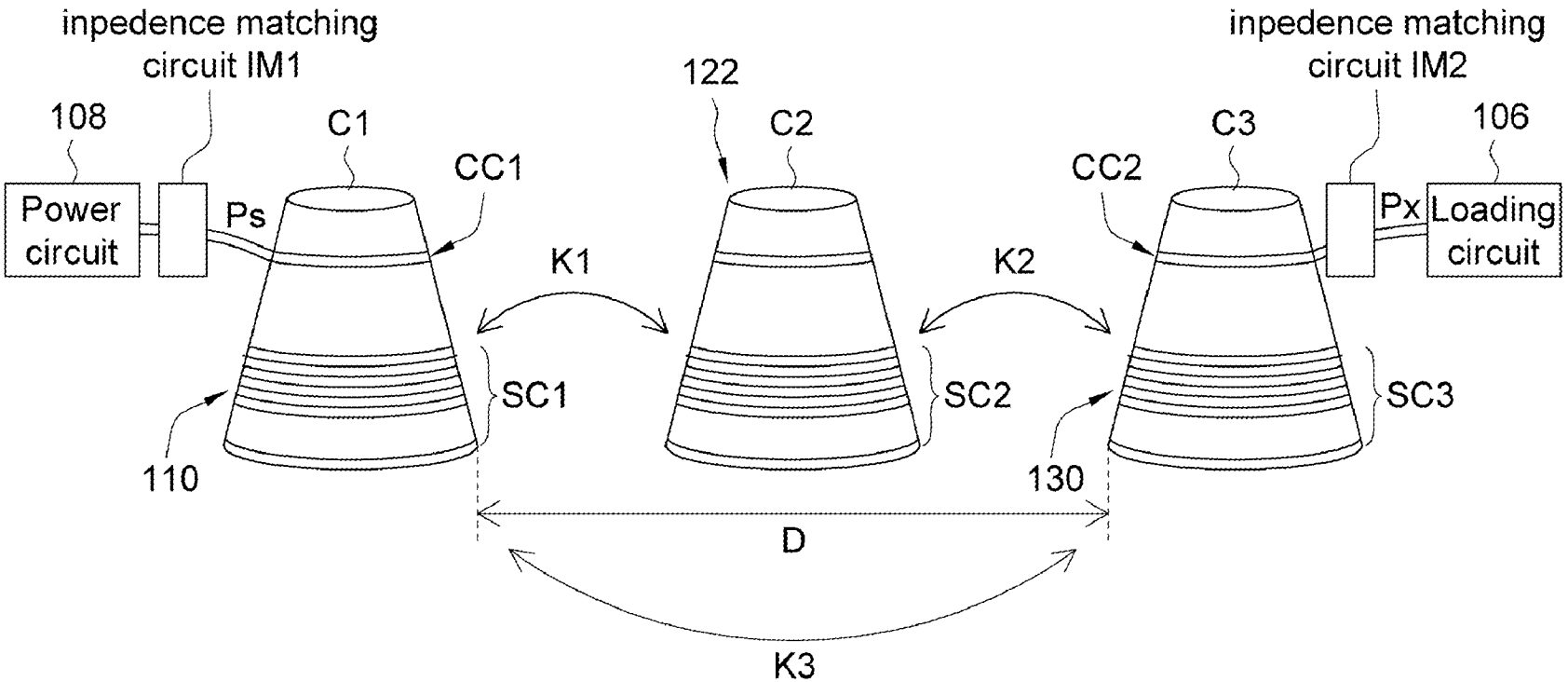
FIG. 2 shows an example of implementing the energy transferring system of FIG. 1 by a solenoid conductive coil.

Referring to FIG. 2, an example of implementing the energy transferring system of FIG. 1 by a solenoid conductive coil is shown. In the present example, the intermediate resonant module 120 includes an intermediate resonator 122. The source-side resonator 110 the intermediate resonator 122 and the device-side resonator 130 are a solenoid conductive coil structure.

The resonant frequency of the source-side resonator 110 is related to the square root of the product of the equivalent capacitance and the equivalent inductance of the source-side resonator 110. The resonant frequencies of the intermediate resonator 122 and the device-side resonator 130 can also be respectively obtained from the corresponding equivalent capacitance and equivalent inductance. As the resonant frequencies of the source-side resonator 110 and the intermediate resonator 122 are substantially the same, the solenoid conductive coil of the source-side resonator 110 will resonate with the solenoid conductive coil of the intermediate resonator 122. Thus, the electromagnetic energy on the source-side resonator 110 will be coupled to the intermediate resonator 122, such that the energy on the source-side resonator 110 is transferred to the intermediate resonator 122.

Likewise, as the resonant frequencies of the intermediate resonator 122 and the device-side resonator 130 are also substantially the same, the solenoid conductive coil of the intermediate resonator 122 will resonate with the solenoid conductive coil of the device-side resonator 130. Thus, the electromagnetic energy on the intermediate resonator 122 will be coupled to the device-side resonator 130, such that the energy on the intermediate resonator 122 is transferred to the device-side resonator 130.

Let the self-inductance of the source-side resonator 110 be L1 and the self-inductance of the intermediate resonator 122 be L2, then the mutual-inductance M12 between the source-side resonator 110 and the intermediate resonator 122 is expressed as:

$$M12=K1\sqrt{L1\times L2} \tag{1}$$

K1 is the first coupling coefficient between the source-side resonator 110 and the intermediate resonator 122 when the solenoid conductive coil is used. Similarly, if the self-inductance of the device-side resonator 130 is L3, then the mutual-inductance M23 between the intermediate resonator 122 and the device-side resonator 130 is expressed as:

$$M23=K2\sqrt{L2\times L3} \tag{2}$$

K2 is the second coupling coefficient between the intermediate resonator 122 and the device-side resonator 130 when the solenoid conductive coil is used. The mutual-inductance M13 between the source-side resonator 110 and the device-side resonator 130 is expressed as:

$$M13=K3\sqrt{L1\times L3} \tag{3}$$

K3 is the third coupling coefficient between the source-side resonator 110 and the device-side resonator 130 when the solenoid conductive coil is used. When the values of M12, M23, and M13 are given, the coupling coefficients K1, K2 and K3 can be obtained from formulas (1), (2) and (3).

Preferably, K1 is larger than K3, and K2 is larger than K3. The larger the coupling coefficient is, the higher the energy transferring efficiency will be. When the intermediate resonator 122 is dispensed, the energy transferring efficiency between the source-side resonator 110 and the device-side resonator 130 is only related to K3. After the intermediate resonator 122 is disposed, as K2 is larger than K3, the energy transferring efficiency between the source-side resonator 110 and the intermediate resonator 122 will be higher than that between the source-side resonator 110 and the device-side resonator 130. Likewise, the energy transferring efficiency between the intermediate resonator 122 and the device-side resonator 130 will also be higher than that between the source-side resonator 110 and the device-side resonator 130. Thus, after the energy on the source-side resonator 110 is transferred to the device-side resonator 130 via the intermediate resonator 122, the efficiency of overall energy transfer of the three resonators will be larger than the efficiency of energy transfer between the source-side resonator 110 and the device-side resonator 130 without the intermediate resonator 122.

As indicated in FIG. 2, the energy transferring system 10 of the present embodiment of the invention further has a power circuit 108, an impedance matching circuit IM1, and a coupling circuit CC1. The power circuit 108 is for generating a power signal Ps. The impedance matching circuit IM1 receives the power signal Ps provided by the power circuit 108 and outputting the power signal Ps. The coupling circuit CC1 is for receiving the power signal Ps provided by the impedance matching circuit IM1 and further coupling the power signal Ps to the source-side resonator 110 so as to provide energy to the source-side resonator 110. The energy transferring system 10 of the present embodiment of the invention further has a loading circuit 106, an impedance matching circuit IM2, and a coupling circuit CC2. The energy Po on the device-side resonator 130 is coupled to the coupling circuit CC2, then the coupling circuit CC2 outputs an energy Px to the impedance matching circuit IM12, which receives and outputs the energy Px to the loading circuit 106. The coupling circuits CC1 and CC2 are implemented by a conductive coil structure. In other example, the energy transferring system 10 of the present embodiment of the invention further has a rectification circuit RCF for receiving the energy Px outputted from an impedance matching circuit IM2' to obtain a rectification signal Px' and providing the rectification signal Px' to the loading circuit 106.

In the present embodiment of the invention, the intermediate resonator 122 is disposed between the source-side resonator 110 and the device-side resonator 130, such that the transferring distance between adjacent resonators of the energy transferring system 10 is reduced, the coupling volume between the resonators is increased and the efficiency of energy transfer is improved.

Figure 3:
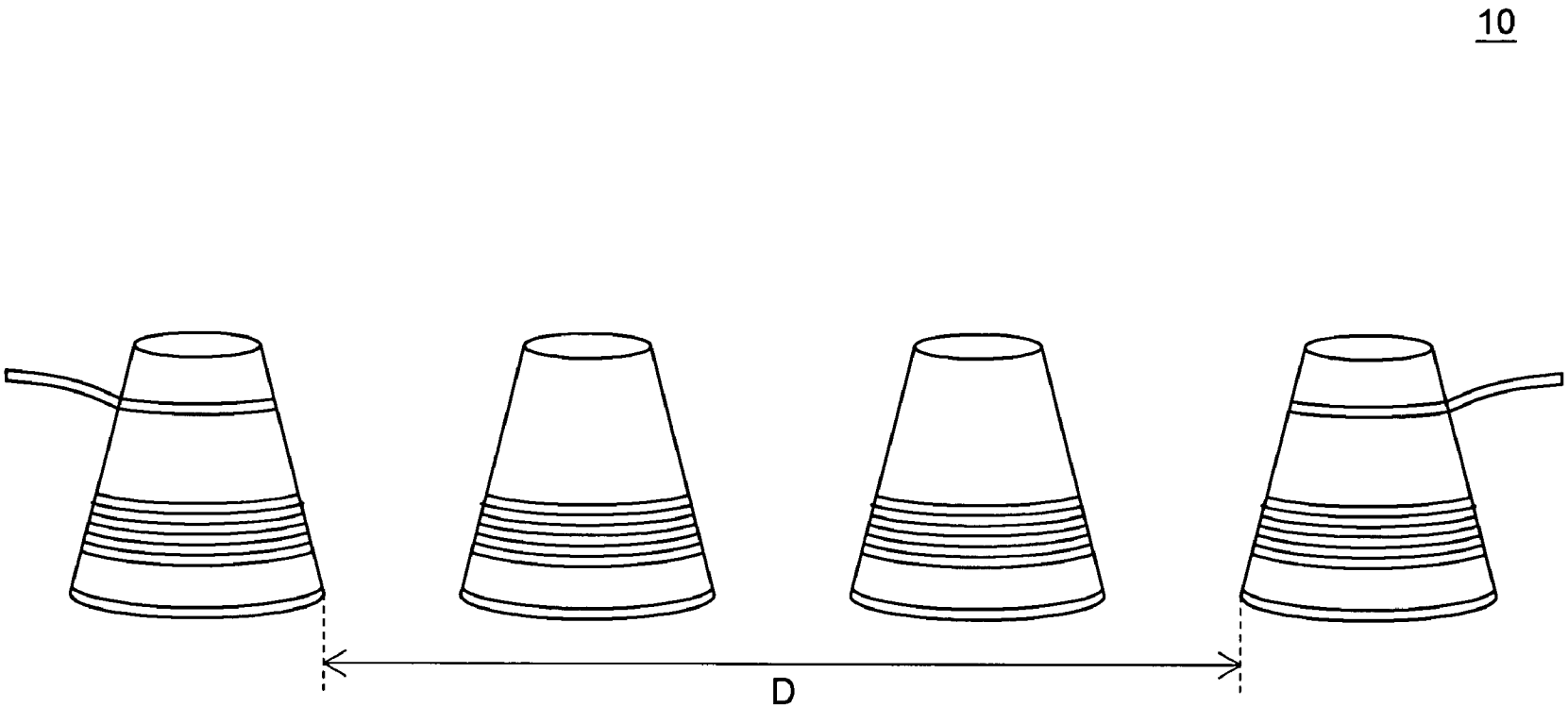
FIG. 3 shows an example of the energy transferring system including two or more than two intermediate resonators.

In the present embodiment of the invention, the intermediate resonant module 120 only includes an intermediate resonator 122. However, the intermediate resonant module 120 is not limited to include one intermediate resonator only, and may include two or more than two intermediate resonators as indicated in FIG. 3. When the transferring distance between the source-side resonator 110 and the device-side resonator 130 becomes larger, more intermediate resonators can be used to perform long distance energy transfer between the source-side resonator 110 and the device-side resonator 130'.

Figure 12A:
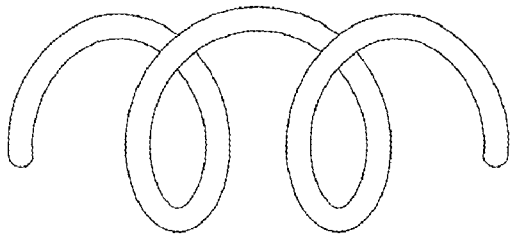
FIGS. 12A-12F respectively show illustrations for a solenoid inductance structure, a dielectric disk structure, a metallic sphere structure, a metallodielectric sphere structure, a plasmonic sphere structure, and a polaritonic sphere structure.
Figure 12B:
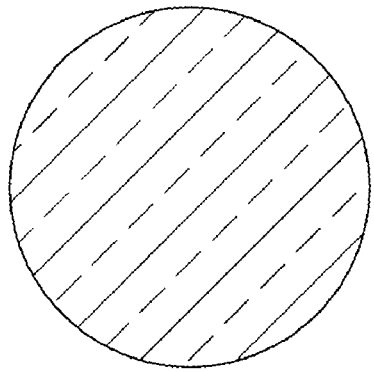
Figure 12C:
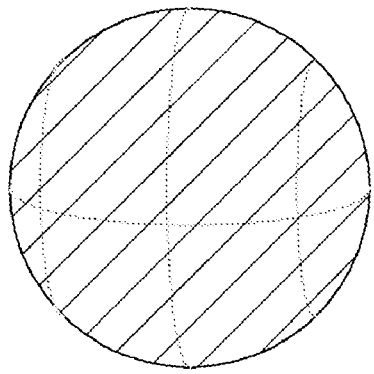
Figure 12D:
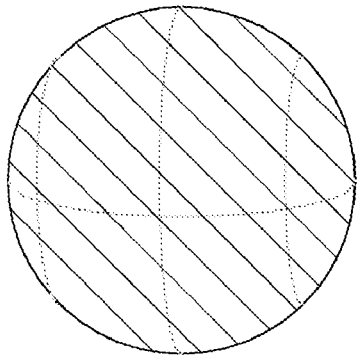
Figure 12E:
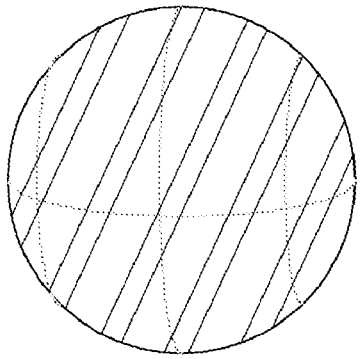
Figure 12F:
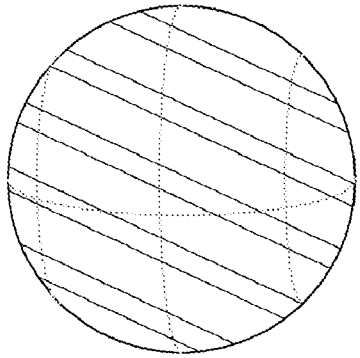
Figure 13:
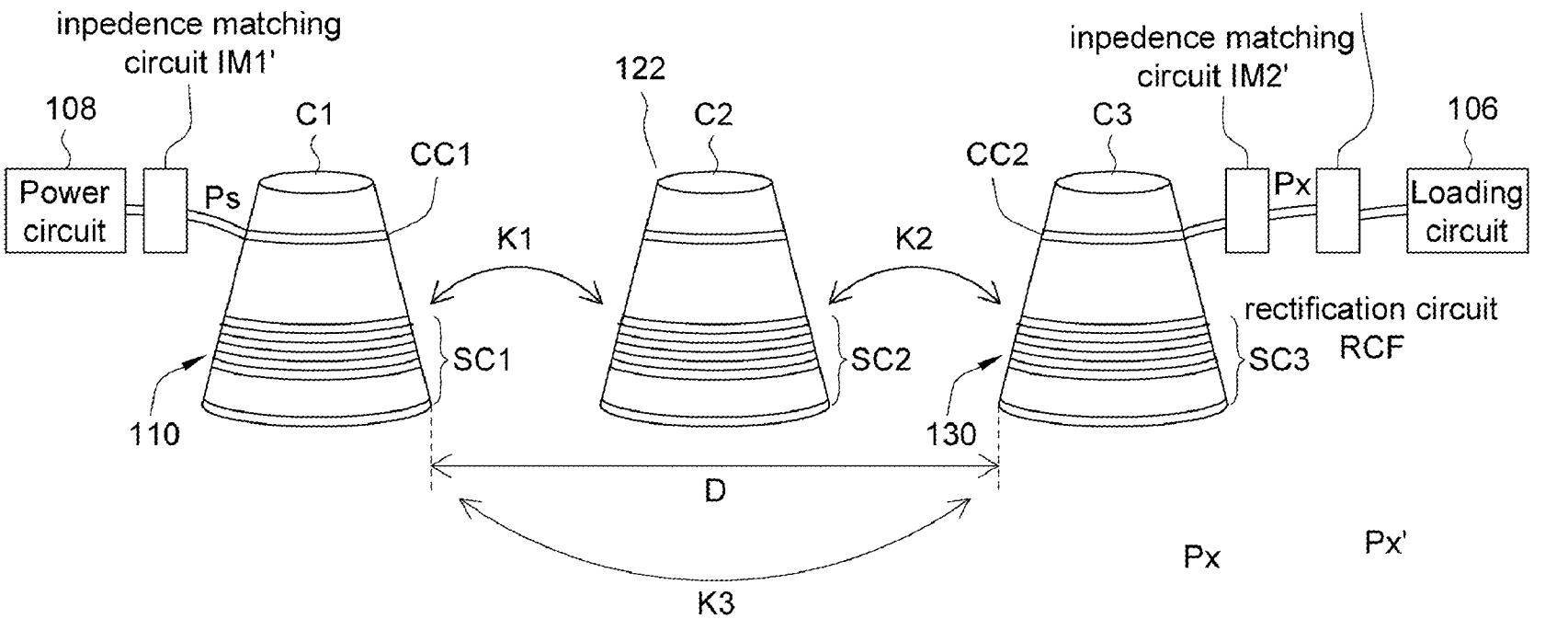
FIG. 13 shows another example of implementing the energy transferring system of FIG. 1 by a solenoid conductive coil.

In the present embodiment of the invention, the source-side resonator 110, the intermediate resonator 122 and the device-side resonator 130 are all exemplified by a resonator with solenoid conductive coil structure, as depicted in FIG. 12A. However, the source-side resonator 110, the intermediate resonator 122 and the device-side resonator 130 may also be implemented by other types of resonators. For example, the source-side resonator 110, the intermediate resonator 122 and the device-side resonator 130 may be a resonator of dielectric disk structure, metallic sphere structure, metallodielectric sphere structure, plasmonic sphere structure, or polaritonic sphere structure, as depicted in FIGS. 12B-12F.

The resonator in the present embodiment of the invention may be implemented by any types of resonators as long as the source-side resonator 110, the intermediate resonator 122 and the device-side resonator 130' have substantially similar resonant frequency.

In the above disclosure, the intermediate resonator 122 is substantially located in the middle of the connecting line between the source-side resonator 110 and the device-side resonator 130. However, the position of the intermediate resonator 122 is not limited thereto. The intermediate resonator 122 can also be located outside the connecting line. Preferably, the transferring distance between the intermediate resonator 122 and the source-side resonator 110 is smaller than that between the source-side resonator 110 and the device-side resonator 130, the transferring distance between the intermediate resonator 122 and the device-side resonator 130 is smaller than that between the source-side resonator 110 and the device-side resonator 130, and the resonators can be disposed in any direction. As long as K1 and K2 are substantially larger than K3, such that the energy coupling between the source-side resonator 110 and the device-side resonator 130' can be increased via the disposition of the intermediate resonator 122 is within the scope of protection of the invention.

In the present embodiment of the invention, the source-side resonator 110, the intermediate resonator 122 and the device-side resonator 130 are mutually coupled via the magnetic energy generated by a solenoid conductive coil to implement energy transfer. However, the energy transferring system of the present embodiment of the invention is not limited to perform energy transfer by way of magnetic energy coupling. Anyone who is skilled in the technology of the invention will understand that the energy transferring system of the present embodiment of the invention can also be mutually coupled by the electric energy generated by the resonators to perform energy transfer.

Simulation Results:

Let the transferring distance D between the source-side resonator 110 and the device-side resonator 130 of FIG. 2 be 66 mm. The intermediate resonator 122 is located in the middle of the connecting line between source-side resonator 110 and the device-side resonator 130.

The solenoid conductive coil structure SC2 of the intermediate resonator 122 is formed by surrounding the bracket C2 using a 5-meter copper wire whose cross-section has a radius of 0.7 mm. The source-side resonator 110 and the device-side resonator 130 are respectively formed by surrounding the bracket C1 and C3 using a 5-meter copper wire whose cross-section has a radius of 0.7 mm.

Thus, the characteristic parameters of the source-side resonator 110, the intermediate resonator 122 and the device-side resonator 130 are resonant frequency fo, unloaded Q factor $Q_U$, loaded Q factor $Q_L$ and external Q factor $Q_{EXT}$. The values of these characteristic parameters are listed in the table of FIG. 4.

Figures 4, 5:
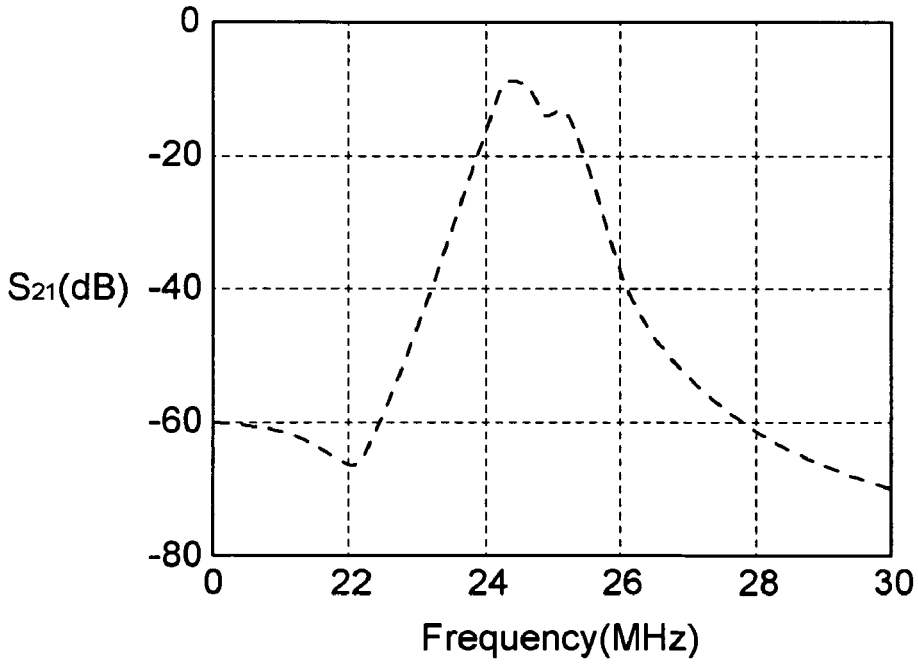
FIG. 4 is an example of the characteristic parameters of a source-side resonator, an intermediate resonator and a device-side resonator.
FIG. 5 shows a relationship diagram of insertion loss $S_{21}$ vs. frequency of the energy transferring system of FIG. 2.

Referring to FIG. 5, a relationship diagram of insertion loss $S_{21}$ vs. frequency of the energy transferring system of FIG. 2 is shown. As indicated in FIG. 5, at frequency 24.4 MHz, the insertion loss $S_{21}$ of the energy transferring system 10 is approximately equal to −10 decibel (dB). According to the formulas:

$$\eta = 10^{-\frac{S_{21}}{10}}$$

the corresponding transferring efficiency η is approximately equal to 10%.

Figure 6:
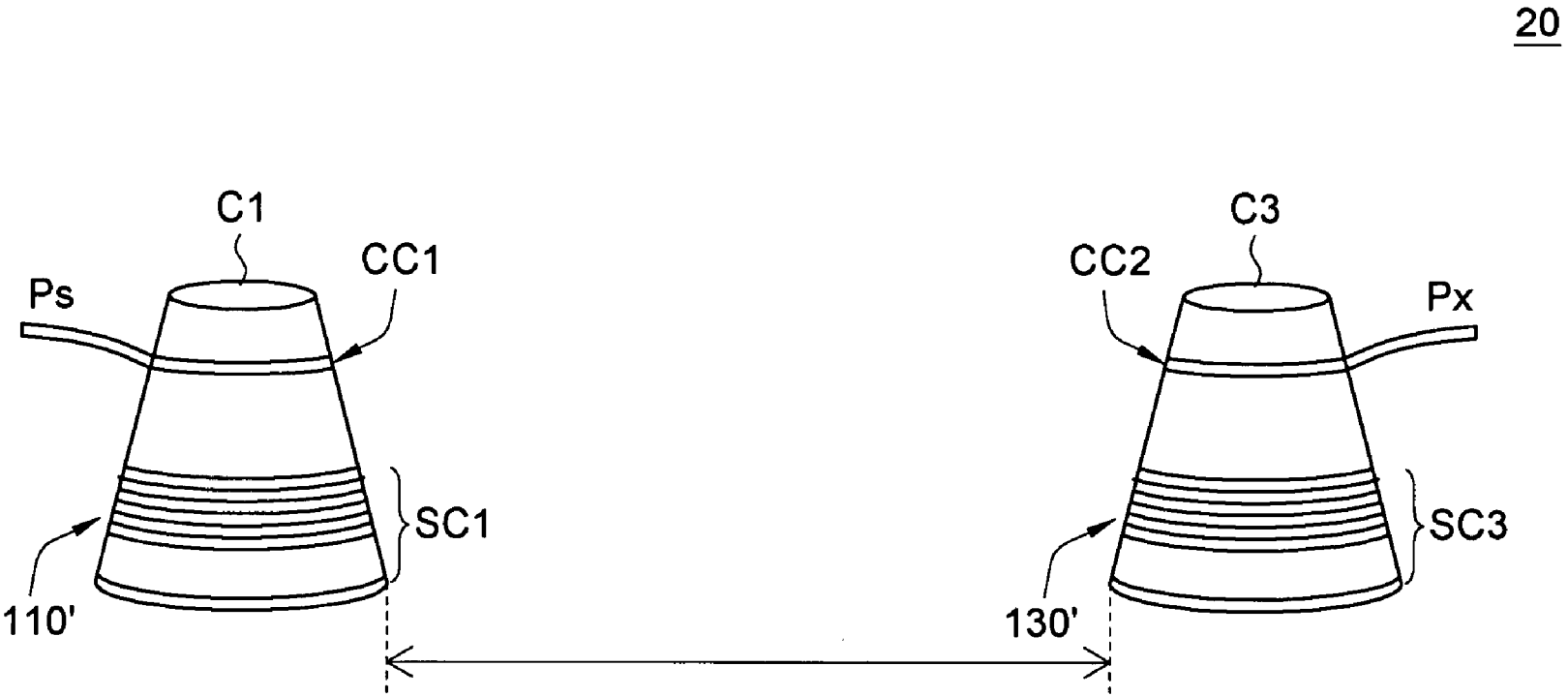
FIG. 6 shows a perspective of the energy transferring system dispensing with the intermediate resonator.

Referring to FIG. 6, a perspective of the energy transferring system dispensing with the intermediate resonator is shown. The energy transferring system 20 of FIG. 6 differs with the energy transferring system 10 of FIG. 2 in that the energy transferring system 20 does not have an intermediate resonator 122, such that the energy on the source-side resonator 110' is directly coupled to the device-side resonator 130'.

Figure 7:
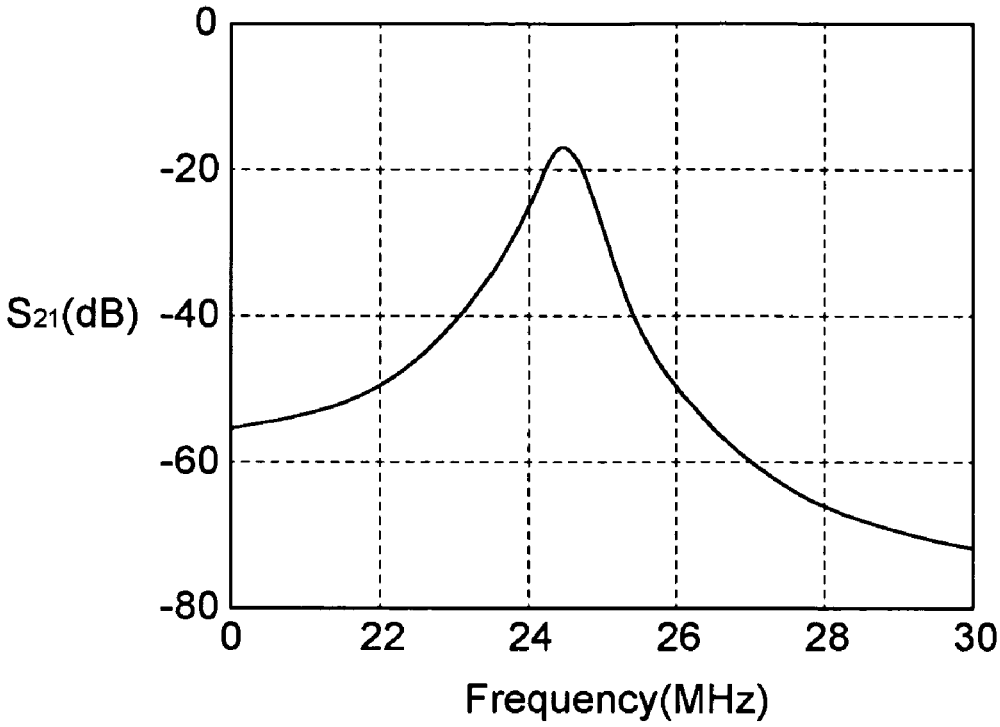
FIG. 7 shows a relationship diagram of insertion loss vs. frequency of the energy transferring system of FIG. 6.

FIG. 7 shows a relationship diagram of insertion loss vs. frequency of the energy transferring system 20 of FIG. 6. As indicated in FIG. 7, at frequency 24.4 MHz, the insertion loss $S_{21}$ of the energy transferring system 20 is approximately equal to −18 dB, and the corresponding transferring efficiency η is approximately equal to 1.5%. According to the comparison between FIG. 5 and FIG. 7, the transferring efficiency η (approximately equal to 10%) of the energy transferring system 10 of the present embodiment of the invention with the intermediate resonator 122 is far higher than the transferring efficiency η (approximately equal to 1.5%) of the energy transferring system dispensed with the intermediate resonator 122.

Figure 8:
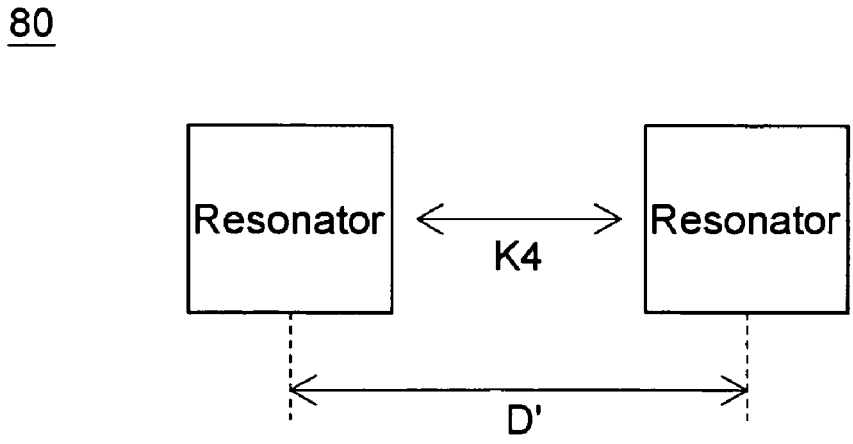
FIG. 8 shows a perspective of a wireless energy transferring system designed according to the United State Patent No. US2007/0222542 and used as a control group.

Referring to FIG. 8, a perspective of a wireless energy transferring system designed according to the United State Patent No. US2007/0222542 and used as a control group is shown. There is a transferring distance D' existing between resonator 1 and resonator 2. The energy on the resonators 1 and 2 are mutually coupled (corresponding to coupling coefficient K4) to perform non-radiative energy transfer. The coupling coefficient K4 is related to the transferring distance between two corresponding resonators.

Figure 9:
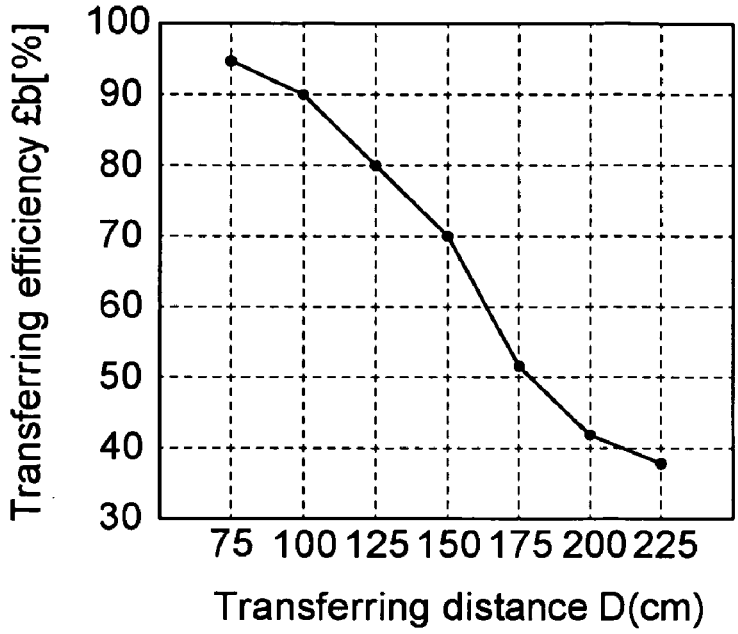
FIG. 9 shows a simulated diagram of transferring efficiency vs. transferring distance of the wireless power transferring system of FIG. 8.

Referring to FIG. 9, a simulated diagram of transferring efficiency vs. transferring distance of the wireless power transferring system of FIG. 8 is shown. The simulation terms of FIG. 9 are that the resonators 1 and 2 are both a helical coil structure whose Q factor is 1000. The relationship of the coupling coefficient K4 vs. the transferring distance between the resonators is listed in Table 1 below.

TABLE 1

| | Transferring distance (cm) | | | | | | |
|---|---|---|---|---|---|---|---|
| | 75 | 100 | 125 | 150 | 175 | 200 | 225 |
| K4 | 0.034 | 0.017 | 0.008 | 0.005 | 0.003 | 0.0022 | 0.0018 |

As indicated in FIG. 9, when the transferring distance is 200 cm, the transferring efficiency is approximately 43%. Let the transferring distance D of the energy transferring system of FIG. 2 be 200 cm, and the positions A, B and C of the source-side resonator 110, the intermediate resonator 122 and the device-side resonator 130 be changed as indicated in FIGS. 11A~11E. The simulation results are shown in FIG. 10.

Figure 10:
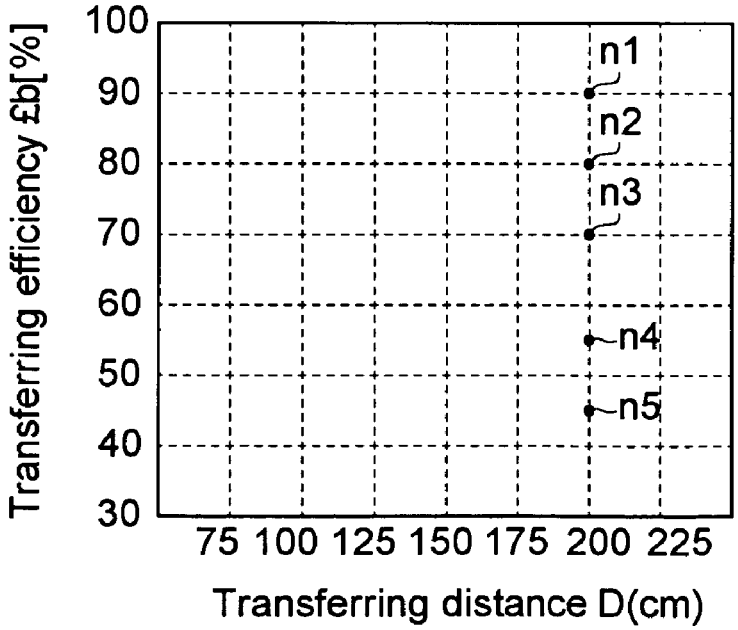
FIG. 10 shows a simulation result when the source-side resonator, the intermediate resonator and the device-side resonator of the energy transferring system of FIG. 2 are positioned at A, B and C as indicated in FIGS. 11A-11E.

The simulation terms of FIG. 10 are that the Q factors of the source-side resonator 110, the intermediate resonator 122, and the device-side resonator 130 are all equal to 1000. The relationship of the coupling coefficient vs. the transferring distance between any two resonators of the source-side resonator 110, the intermediate resonator 122, and the device-side resonator 130 are listed in Table 1.

Figure 11A:
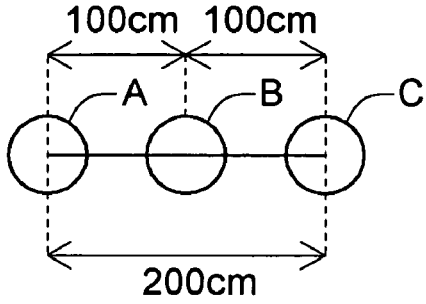
FIGS. 11A-11E show multiple positioning relationships of the source-side resonator, the intermediate resonator and the device-side resonator of the energy transferring system of FIG. 2.
Figure 11B:
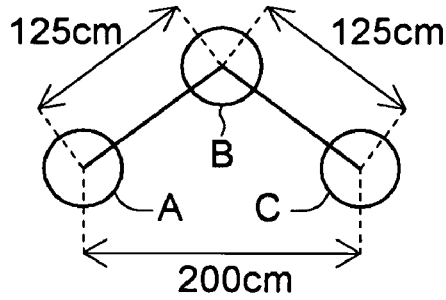

Referring to both FIG. 10 and FIG. 11A. When the position B of the intermediate resonator 122 is substantially located in the middle point of the connecting line between the position A of the source-side resonator 110 and the position C of the device-side resonator 130, the transferring efficiency η of the energy transferring system 10 of the present embodiment of the invention is substantially the point n1 of FIG. 10. That is, the transferring efficiency η is 90%. Referring to FIG. 11B. Compared with the wireless energy transferring system of FIG. 9 whose transferring efficiency η is approximately equal to 43% when the transferring distance between the resonator 1 and the resonator 2 is substantially equal to 200 cm, the energy transferring system 10 of the present embodiment of the invention substantially has a better transferring efficiency η.

Figure 11C:
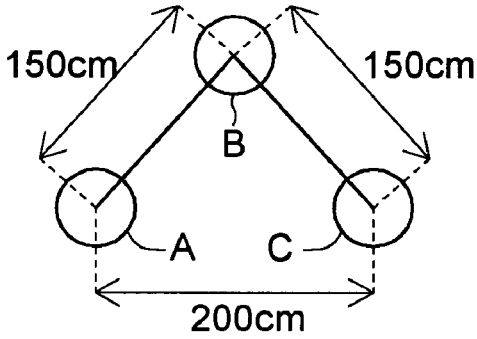
Figure 11D:
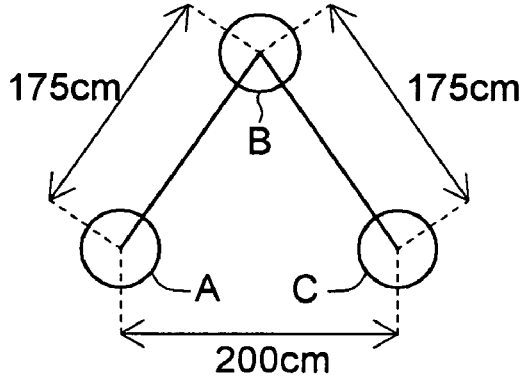
Figure 11E:
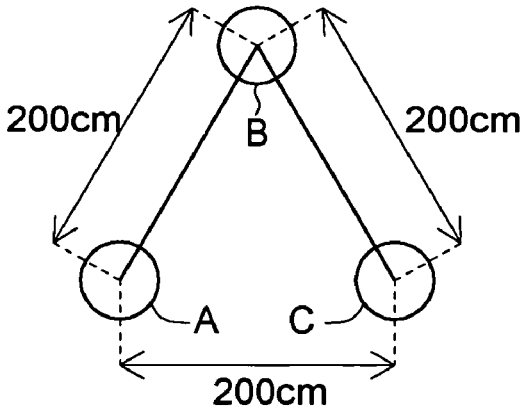

When the positions A, B and C of the source-side resonator 110, the intermediate resonator 122 and the device-side resonator 130 are as indicated in FIG. 11B, the transferring efficiency η of the energy transferring system of the present embodiment of the invention is the point n2 as indicated in FIG. 10. That is, the transferring efficiency η is equal to 80%. When the positions A, B and C of the source-side resonator 110, the intermediate resonator 122 and the device-side resonator 130 are respectively as indicated in FIG. 11C, FIG. 11D and FIG. 11E, the transferring efficiency η of the energy transferring system 10 of the present embodiment of the invention are substantially indicated as the points n3, n4 and n5 of FIG. 10. That is, the transferring efficiencies η are respectively equal to 70%, 55% and 45%. Compared with the wireless energy transferring efficiency of FIG. 9, the energy transferring system 10 of the present embodiment of the invention according to various forms of relative disposition as indicated in FIG. 11A to 11E still has better transferring efficiency than the wireless energy transferring system 80 of FIG. 8.

According to the energy transferring system of the invention, an intermediate resonant module is disposed between a source-side resonator and a device-side resonator to perform energy coupling with the source-side resonator and the device-side resonator respectively, such that the overall coupling parameters between the source-side resonator and the device-side resonator and the transferring efficiency are both improved. Compared with a conventional wireless non-radiative energy transferor, the energy transferring system of the invention has a higher energy transferring efficiency, and achieves high transferring efficiency by way of low Q-factor resonators. As the low Q-factor resonators have small volume, the energy transferring system of the invention further has the advantages of small volume and low cost.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An energy transferring system, comprising:

a source-side resonator for receiving an energy, wherein the source-side resonator has a first resonant frequency;

an intermediate resonant module having a second resonant frequency substantially the same with the first resonant frequency, wherein the energy on the source-side resonator is coupled to the intermediate resonant module, such that non-radiative energy transfer is performed between the source-side resonator and the intermediate resonant module, and the coupling between the source-side resonator and the intermediate resonant module corresponds to a first coupling coefficient; and a device-side resonator having a third resonant frequency substantially the same with the second resonant frequency, wherein the energy coupled to the intermediate resonant module is further coupled to the device-side resonator, such that non-radiative energy transfer is performed between the intermediate resonant module and the device-side resonator, and the coupling between the intermediate resonant module and the device-side resonator corresponds to a second coupling coefficient;

wherein the coupling between the source-side resonator and the device-side resonator corresponds to a third coupling coefficient;

wherein the first coupling coefficient is larger than the third coupling coefficient, and the second coupling coefficient is larger than the third coupling coefficient.

2. The energy transferring system according to claim 1, wherein magnetic energy transfer is performed between the source-side resonator and the intermediate resonant module.

3. The energy transferring system according to claim 1, wherein power energy transfer is performed between the source-side resonator and the intermediate resonant module.

4. The energy transferring system according to claim 1, further comprising:

a power circuit for generating a power signal to provide the energy;

a first impedance matching circuit for receiving a power signal provided by the power circuit and outputting the power signal;

a first coupling circuit for receiving the power signal outputted from the first impedance matching circuit, wherein the first coupling circuit and the source-side resonator are mutually coupled to each other, such that energy transfer is performed between the first coupling circuit and the source-side resonator to transfer the energy to the source-side resonator.

5. The energy transferring system according to claim 1, further comprising:

a first coupling circuit mutually coupled with the device-side resonator for outputting the energy received by the device-side resonator;

a first impedance matching circuit for receiving the energy outputted from the first coupling circuit and outputting the energy; and a rectification circuit for receiving the energy outputted from the first impedance matching circuit to obtain a rectification signal.

6. The energy transferring system according to claim 1, wherein the intermediate resonant module has at least one intermediate resonator.

7. The energy transferring system according to claim 6, wherein the intermediate resonator is a conductive coil structure with parasitic capacitance.

8. The energy transferring system according to claim 6, wherein the intermediate resonator has a dielectric disk structure.

9. The energy transferring system according to claim 6, wherein the intermediate resonator has a metallic sphere structure.

10. The energy transferring system according to claim 6, wherein the intermediate resonator has a metallodielectric sphere structure.

11. The energy transferring system according to claim 6, wherein the intermediate resonator has a plasmonic sphere structure.

12. The energy transferring system according to claim 6, wherein the intermediate resonator has a polaritonic sphere structure.

13. The energy transferring system according to claim 1, wherein the source-side resonator has a solenoid inductance structure.

14. The energy transferring system according to claim 1, wherein the device-side resonator has a solenoid inductance structure.

15. An energy transferring method, comprising:

providing a source-side resonator to receive an energy;

providing an intermediate resonant module, wherein the energy on the source-side resonator is coupled to the intermediate resonant module, such that non-radiative energy transfer is performed between the source-side resonator and the intermediate resonant module, and the coupling between the source-side resonator and the intermediate resonant module corresponds to a first coupling coefficient; and providing the energy for coupling a device-side resonator to the intermediate resonant module, wherein the energy is further coupled to the device-side resonator, such that non-radiative energy transfer is performed between the intermediate resonant module and the device-side resonator, and the coupling between the intermediate resonant module and the device-side resonator corresponds to a second coupling coefficient, wherein:

the coupling between the source-side resonator and the device-side resonator corresponds to a third coupling coefficient; and the first coupling coefficient is larger than the third coupling coefficient, and the second coupling coefficient is larger than the third coupling coefficient.

16. The energy transferring method according to claim 15, wherein the source-side resonator, the intermediate resonant module and the device-side resonator respectively have a first resonant frequency, a second resonant frequency and a third resonant frequency, and the first resonant frequency, the second resonant frequency and the third resonant frequency are substantially the same.

* * * * *